US009061351B2

(12) United States Patent
Kulkarni et al.

(10) Patent No.: US 9,061,351 B2
(45) Date of Patent: Jun. 23, 2015

(54) MULTICOMPONENT TITANIUM ALUMINIDE ARTICLE AND METHOD OF MAKING

(75) Inventors: Kaustubh Narhar Kulkarni, Kundalahalli (IN); Anil K. Sachdev, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 895 days.

(21) Appl. No.: 13/293,651

(22) Filed: Nov. 10, 2011

(65) Prior Publication Data

US 2013/0121869 A1 May 16, 2013

(51) Int. Cl.

| | |
|---|---|
| ***B22F 1/00*** | (2006.01) |
| ***B22F 3/10*** | (2006.01) |
| ***C22C 14/00*** | (2006.01) |
| ***C22C 21/00*** | (2006.01) |
| ***B22F 5/00*** | (2006.01) |
| ***B22F 9/08*** | (2006.01) |
| ***C22C 1/04*** | (2006.01) |
| ***F01L 3/02*** | (2006.01) |
| *F01L 1/46* | (2006.01) |

(52) U.S. Cl.

CPC ..... *B22F 5/008* (2013.01); *C22C 14/00* (2013.01); *C22C 21/00* (2013.01); *B22F 9/082* (2013.01); *C22C 1/0491* (2013.01); *B22F 2998/10* (2013.01); *B22F 2999/00* (2013.01); *F01L 1/462* (2013.01); *F01L 3/02* (2013.01)

(58) Field of Classification Search

CPC ..... B22F 3/1039; B22F 9/082; B22F 1/0003; B22F 5/008; C22C 1/0491; C22C 14/00; C22C 21/00

USPC ..... 419/30; 420/418, 419, 420, 552, 553

See application file for complete search history.

(56) References Cited

U.S. PATENT DOCUMENTS

| | | | | |
|---|---|---|---|---|
| 2,852,366 | A * | 9/1958 | Jenkins | 419/10 |
| 4,540,546 | A * | 9/1985 | Giessen | 420/552 |
| 4,707,332 | A * | 11/1987 | Huether | 419/28 |
| 4,808,372 | A * | 2/1989 | Koczak et al. | 420/552 |
| 4,915,908 | A * | 4/1990 | Nagle et al. | 420/590 |
| 4,917,858 | A | 4/1990 | Eylon et al. | |
| 5,433,799 | A * | 7/1995 | Kampe et al. | 420/418 |
| 5,768,679 | A * | 6/1998 | Taguchi et al. | 428/548 |
| 6,805,759 | B2 * | 10/2004 | Hoffmann et al. | 420/418 |
| 7,566,415 | B2 * | 7/2009 | Moxson et al. | 419/48 |
| 2006/0147333 | A1 * | 7/2006 | Moxson et al. | 419/32 |
| 2009/0252643 | A1 * | 10/2009 | Doty et al. | 420/533 |

* cited by examiner

*Primary Examiner* — Helene Klemanski
(74) *Attorney, Agent, or Firm* — Reising Ethington P.C.

(57) ABSTRACT

A process for fabricating sintered, substantially pore-free titanium aluminide articles with minor alloying element additions is disclosed. Such articles may find application as automobile engine valves and connecting rods and may be fabricated by rapidly sintering intimately mixed powders of substantially pure titanium and rapidly-cooled particles of aluminum alloyed with the minor alloying element(s).

16 Claims, 3 Drawing Sheets

MULTICOMPONENT TITANIUM ALUMINIDE ARTICLE AND METHOD OF MAKING

TECHNICAL FIELD

This invention pertains to methods of making sintered articles comprising the intermetallic compound, gamma titanium aluminide (γ-TiAl), as the major metallurgical phase with other minor phases and also containing other alloying elements. More specifically, this invention pertains to methods of sintering compacted preform mixtures of substantially pure titanium particles with particles of rapidly solidified mixtures of aluminum and the other alloying element(s) to form such articles with low porosity and desired microstructures.

BACKGROUND OF THE INVENTION

Increasingly, the material mix used in trucks and automobiles is changing from low strength, low carbon steel to materials which can, cost-effectively, offer higher specific strength (strength/density). Titanium alloys offer some of the highest specific strengths (strength/density) of all structural alloys, good corrosion and oxidation resistance and good fatigue properties and so should be appealing for automotive applications. But because material and processing costs for titanium-based alloys have not been attractive, titanium and titanium-based alloys and compounds have found only limited application.

Thus, there remains a general need for new practices for manufacturing titanium alloys because they can find applications in automotive vehicles such as, for example, in valves, connecting rods, and springs, and other engine components. The substitution of lower density titanium alloys for ferrous alloys may enable higher maximum engine operating speeds and up to an 8% increase in engine power. Since new electrolytic processes are now becoming available that can offer pure Ti powder at very low cost, there is increasing interest in developing new methods for manufacturing sintered Ti-alloys using these low cost Ti-powders.

Gamma titanium aluminide, γ-TiAl, (as indicated with equal atomic proportions of titanium and aluminum) is a material considered for use in aeronautical applications. It could find automotive applications if it could be processed at acceptable cost levels. It is often prepared in combination with minor proportions of one or more of Nb, Cr, Mn, Mo, Si, Cu, Fe, Sn and V, generally indicated as X, and added for selective enhancement of ductility, corrosion or oxidation resistance or other engineering attributes. But there is a nearly one thousand degree Celsius difference in the melting points of titanium and aluminum. This fact and other processing issues have complicated the preparation of useful article shapes of γ-TiAl—X compositions for automotive applications when using blended elemental powder mixtures of the desired composition.

There is, therefore, a need for an improved method of making titanium alloy articles in general, and there is a particular need for making articles comprising γ-TiAl with relatively minor alloying additions where the individual elemental additions have widely-varying melting points.

SUMMARY OF THE INVENTION

This invention provides general practices for making sintered articles of titanium-based alloys and, more specifically and preferably, for making sintered articles comprising gamma titanium aluminide as the major metallurgical phase. A candidate sintered titanium alloy for automobile engine components such as valves and connecting rods is γ-TiAl—X, where X represents one or more minor additions of Nb, Cr, Mn, Mo, Si, Cu, Fe, Sn and V, among others.

In accordance with practices of this invention, substantially pure particles of titanium are used in a sintering process. The titanium particles are prepared to have suitable size(s) for sintering in a mixture with particles containing aluminum and X in combination. A generally homogeneous melt of aluminum with the one or more elemental alloying constituents (X) is prepared with the X constituent(s) dissolved in the liquid aluminum. The liquid is then rapidly solidified by a suitable practice to obtain flakes or other particle shapes. Preferably the particles are a generally homogenous mixture of aluminum and the X element(s), but some small, finely-dispersed precipitates of an X-containing phase may be present. If necessary the solidified particles of aluminum and X may be reduced to a particle size (or size range) for mixing and sintering with the titanium particles. But an important aspect of this invention is the preparation of rapidly solidified (or otherwise homogenized) particles of Al—X prior to sintering, so that the X elements are initially carried or transported in aluminum, preferably liquid aluminum, for inter-diffusion with titanium particles during the sintering process. This practice is found to hasten the sintering process, to more reliably produce desired microstructures, and to produce less porous sintered products.

In the practices of this invention, directed to shaped, sintered articles of γ-TiAl—X composition, the elemental proportions of titanium and aluminum will be appropriately close to equal atomic proportions. The respective values of atomic weights and densities for titanium and aluminum are such that the sintering mixture may contain a few more Al—X particles than titanium particles (depending on initial particles sizes). In many embodiments, an initial excess of relatively small aluminum particles around larger titanium particles may be advantageous in achieving more rapid and effective inter-diffusion between the mixed particles in a compressed particle body because of the large difference in the melting points of titanium and aluminum. But, in each practice of the invention, the respective sizes of the Ti particles and Al—X particles are determined and specified to achieve effective sintering rates and full consolidation of the mixed particles to achieve the desired microstructure in the sintered product.

As described in detail in this specification, a suitable mixture of Ti particles and Al—X particles is prepared and the mixture shaped and compacted in a suitable mold or die to obtain a self-sustaining green-body for sintering that is of a predetermined precursor shape. And the compacted body is sintered. The time-temperature-pressure program for sintering is determined by trial, experience, computer modeling, or the like to obtain a sintered microstructure of a gamma titanium aluminide phase with X in solution in the γ-TiAl phase, or with one or more secondary phases of predominately X, a mixture of aluminum (or $Al_3Ti$) and X, or the like. In most embodiments, the time-temperature-pressure processing program will be conducted to maintain a liquid aluminum-rich phase to promote rapid diffusion of aluminum and the X constituents into the solid, growing titanium particles and diffusion of titanium into the liquid aluminum phase. Initial diffusion of aluminum into the titanium particles may initially produce some unwanted metallurgical structures (e.g., $Al_3Ti$) that will be reduced or replaced by further inter-diffusion between the particles in the precursor compact.

This invention seeks to promote more rapid sintering of alloys and compounds of titanium and aluminum with minor additions of one or more other constituents such as Nb, Cr, Si and others which may be present, collectively, in an amount from 0.1 to 10 atomic %. It is preferred that substantially equal atomic proportions of Al and Ti are employed so that the sintered compact will comprise substantially γ-TiAl. The minor constituents, collectively and individually, will be generally referred to as X so that, unless otherwise indicated, X may be used to refer to a single additive constituent or to multiple additive constituents. For convenience, the resulting aluminide will be referred to as TiAl—X where it may be understood that, at the conclusion of the sintering process, the structure will comprise γ-TiAl as a major phase with X in solid solution or as a constituent of another phase. The final microstructure desired depends on the properties required.

Rapid sintering to form the desired γ-TiAl composition may be achieved by first melting aluminum at a suitable temperature in the presence of X to form a homogeneous liquid alloy of aluminum and X. This liquid Al—X alloy may then be rapidly cooled to suppress any phase transformation on cooling. Many X do not form extensive solid solutions with aluminum and so would, if the alloy were cooled slowly, precipitate particles of a different composition than the melt composition. Rapid cooling, for example splat cooling or gas atomization using water as the atomizing agent may result in higher cooling rates and, at least substantially suppress such segregation. Even if segregation is not completely suppressed the scale of the segregation will be markedly reduced with any precipitates finely-dispersed within the small individual particles. This will facilitate rapid re-homogenization of the molten alloy during sintering if the selected sintering temperature equals or exceeds the initial melting temperature of the Al—X composition.

Sintering may be conducted at a temperature greater than the liquidus temperature of the rapidly cooled aluminum particles but lower than the melting point of the substantially pure titanium particles. On melting, the aluminum may be wicked into the pores between the titanium particles by capillary action and wet the particles so that the entire surface area of the particles may participate in the diffusion process. Solid state diffusion of titanium will occur, and so, to limit the diffusion distance, the particle size may be small, ranging from between 1 and 10 micrometers and preferably less than 3 micrometers. Since the particles of aluminum alloyed with X will melt, the size of the aluminum-containing particles is not critical to diffusion. Preferably however, since the volume ratio of titanium to aluminum will be about 1.07 to 1.0 or so, the aluminum particles may be of comparable or lesser size than the titanium particles, for efficient particle packing.

The presence of liquid generally increases the rate at which a powder compact will consolidate. First, as noted, because the liquid effectively wets the remaining solid particle and increases the active area of the particles participating in the diffusion, particularly during the early stages of the process. Second, diffusion will occur more rapidly in, or through, a liquid than a solid.

If however the liquid forms a higher melting point compound with the remaining powder, as is observed in existing practices, these advantages may be lost if the shell of higher melting point compound such as $Al_3Ti$, formed on the particle, slows and impedes further diffusion.

But pre-alloying the aluminum with X enables the aluminum-rich liquid to co-exist with Ti as well as any high melting point compound, such as $Al_3Ti$, which may form, so that rapid interdiffusion of Ti and Al may be obtained largely throughout the liquid-diffusion process. In some cases it may be necessary to gradually increase the temperature as the reaction proceeds to maintain the liquid present.

Also, such Al—X liquid alloy reaction with titanium results in less porosity than obtained in solid-solid diffusion processes.

Other objects and advantages of the invention will be further apparent from a detailed description of illustrative embodiments of the invention will follow in this specification. Reference is made to drawing figures which are described in the following section of this specification.

DESCRIPTION OF PREFERRED EMBODIMENTS

Figures 1A, 1B, 1C:
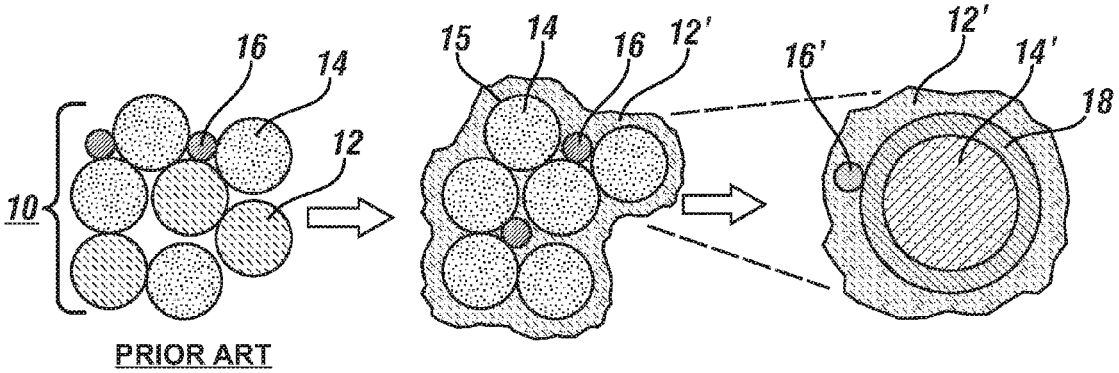
PRIOR ART FIG. 1A FIG. 1B FIG. 1C
FIG. 1 illustrates the progress of sintering to form titanium aluminides with minor alloying additions from blended elemental powders according to the prior art.
Figures 1D, 1E:
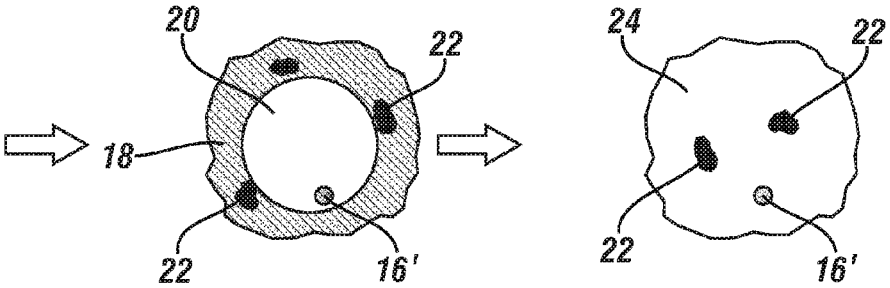

Titanium-based alloys in general and titanium aluminides, especially γ-TiAl, have long been recognized as offering potential benefits in reducing vehicle mass, particularly the mass of vehicle engines. But raw material and fabrication costs have limited enthusiasm for titanium alloy components and they have found only limited application.

Electrochemical processes for preparing titanium powder at low temperature have lowered its cost relative to powder prepared by melting and gas atomization so that interest has revived in titanium alloys prepared by powder metallurgy techniques.

γ-TiAl commonly contains minor proportions of one or more of Nb, Cr, Mn, Mo, Si, Cu, Fe, Sn and V, collectively and individually referred to as X in this specification. X, in total ranging from 0.1 to 10 atomic %, is added to enhance particular engineering characteristics, most commonly high temperature oxidation resistance but Nb additions, in particular, are also effective in improving high temperature strength.

Such γ-TiAl—X compounds may be prepared by sintering commingled finely divided generally pure powder mixtures of Ti, Al and X. But the process proceeds slowly, requiring extended sintering times. Also, because solid-solid interdiffusion occurs the resulting sintered compound frequently contains high levels of porosity from the large differences in the diffusivities, of the diffusing species.

The origin of this behavior may be seen by consideration of FIGS. 1A-E which is illustrative of the prior art. An initial compact 10 of aluminum 12, titanium 14, and X particles 16 is prepared (FIG. 1A) with near equal atomic proportions of titanium and aluminum. The compact 10 is then heated under pressure, generally in the presence of a reducing or inert atmosphere, such as hydrogen, argon, or under vacuum, to a suitable sintering temperature. The sintering temperature is commonly greater than the melting point of aluminum but less than the melting point of either titanium or X rendering the aluminum molten so that it forms a liquid film 12' (FIG. 1B) which wets and coats titanium particles 14 and X particles 16. At some later time, as seen in the expanded representation of a single particle and aluminum film shown in FIG. 1C, interdiffusion of aluminum and titanium occurs across titanium particle surface 15 (FIG. 1B) forming a layer of $Al_3Ti$ intermetallic compound 18 around the core of partially consumed titanium particle 14'. Particle 16 (FIG. 1B), may be incorporated into the growing shell of $Al_3Ti$ or, as shown, remain immersed in the molten aluminum-rich film 12' while undergoing minimal dissolution to form particle 16'. At a still later time, all of the molten elemental Al has been consumed to form an expanded shell 18 of $Al_3Ti$ (FIG. 1D) surrounding an inner core 20 of a mixture of TiAl and $Ti_3Al$ incorporating X particle 16'. As a result of the differing diffusivities of aluminum and titanium pores or voids 22 have formed in core 20. At the conclusion of the sintering process (FIG. 1E) the entire volume 24 has been transformed to its final composition and comprises a mixture of TiAl and $Ti_3Al$ with some dissolved X. The remainder of the X is embedded in the microstructure as particle 16' and voids 22 persist, now, like remnant X particle 16', embedded in volume 24.

Figures 2A, 2B, 2C:
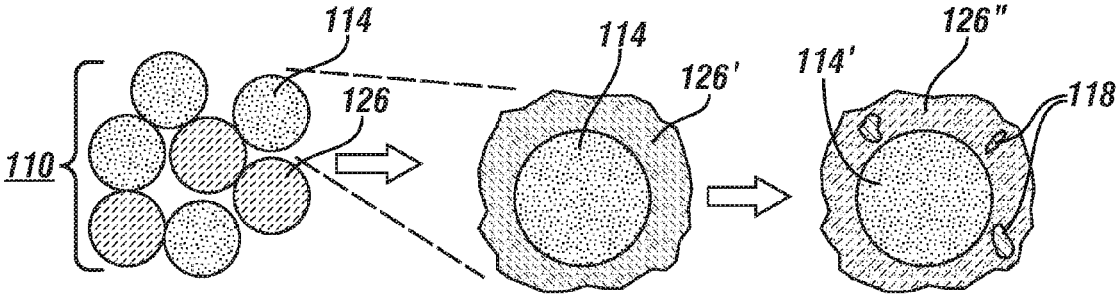
FIG. 2 illustrates the progress of sintering to form titanium aluminides with minor alloying additions from titanium powder and aluminum pre-alloyed with the minor alloying addition according to the practices of the invention.
Figures 2D, 2E:
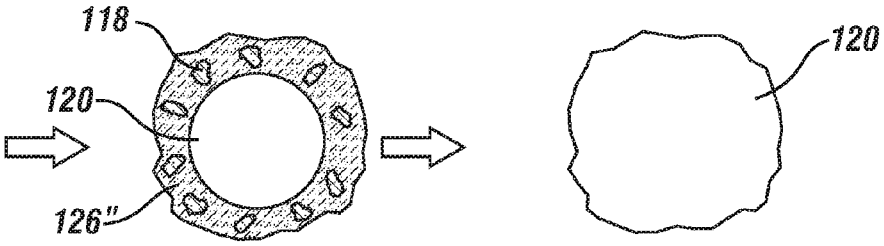

FIGS. 2A-E illustrate the practice of the invention. FIG. 2A shows a powder compact 110 of titanium particles 114 and of Al—X aluminum particles 126. As will be described below the Al—X particles may be a supersaturated solution of X in Al, or a fine dispersion of X or a stable or metastable compound of aluminum and X. Again it is preferred to conduct sintering under a reducing atmosphere, an inert atmosphere, or vacuum. Maintaining an applied pressure on compact 110 while raising the temperature to a sintering temperature which is less than the melting temperature of titanium but greater than the liquidus temperature of the Al—X particles will result in the structure illustrated in FIG. 2B in which titanium particle 114 is surrounded by liquid Al—X, 126'. At some later time (FIG. 2C), partial dissolution of titanium has occurred but that titanium particle 114' is surrounded by Ti-enriched Al—X liquid 126", now containing some $Al_3Ti$ particles 118. At a still later time (FIG. 2D), after yet further diffusion, the structure consists of a center core of a TiAl+ $Ti_3Al$ mixture 120, still surrounded by Ti-enriched Al—X liquid 126" containing $Al_3Ti$ particles 118. At the conclusion of the process, illustrated in FIG. 2E, a generally uniform, pore-free microstructure of TiAl and $Ti_3Al$ containing dissolved X (stage 120) results.

Beneficially, the revised process maintains a liquid phase throughout the sintering process so that no solid-solid diffusion and resulting porosity results from the dissimilar diffusion coefficients of aluminum and titanium. The liquid phase is retained at the Ti particle surface because although the components are the same as in the prior art, two of the components, aluminum and X, are present as a single liquid phase rather than as two distinct and separate phases. The resulting ternary interdiffusion, in accord with the phase rule, makes it thermodynamically possible for the liquid phase to co-exist with the Ti—Al intermetallic compound $Al_3Ti$ as sintering proceeds. If required, the sintering temperature and/or pressure may be systematically varied during sintering to maintain a liquid phase in contact with Ti.

Figure 3:
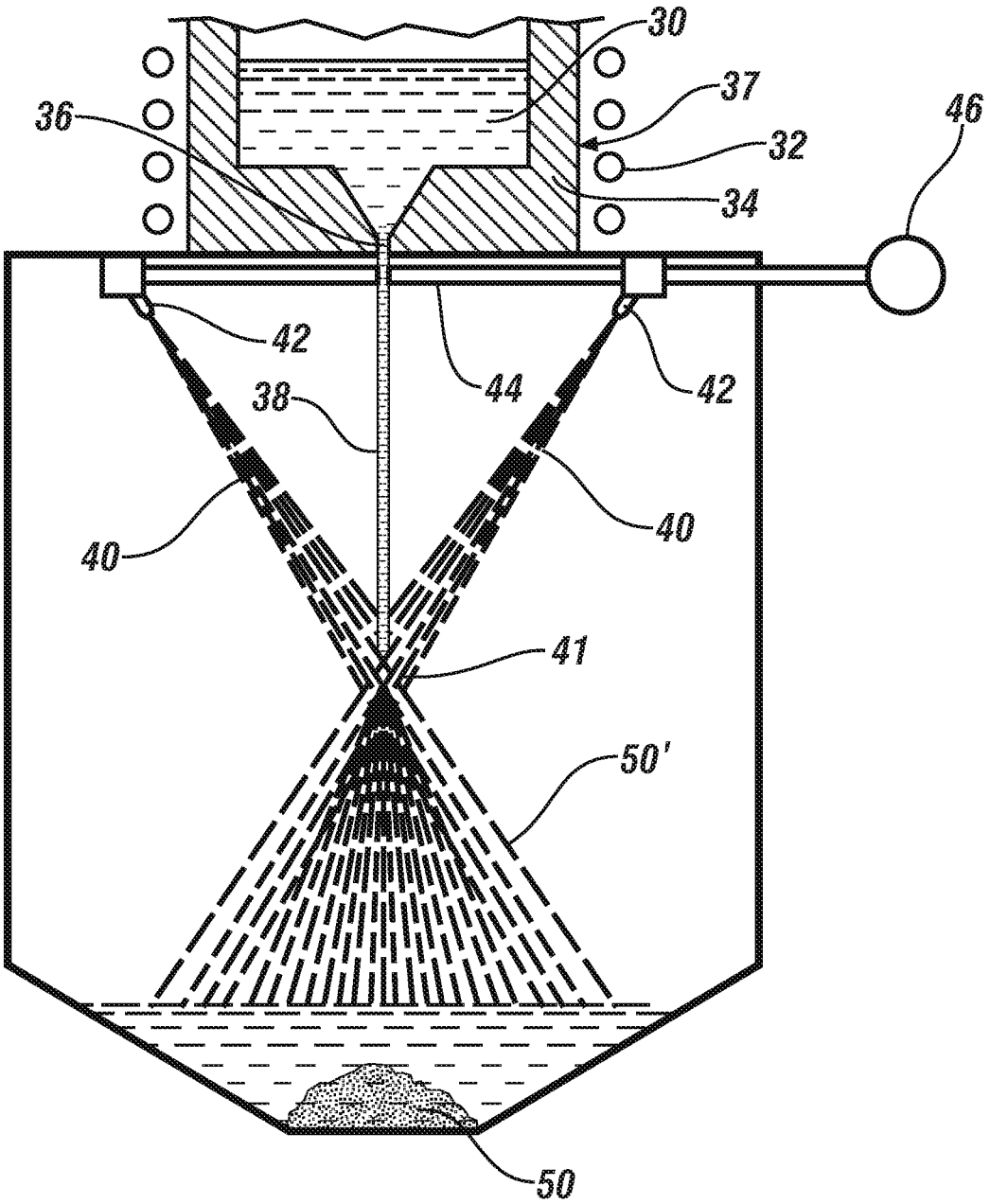
FIG. 3 shows a gas atomizer for production of metal powder.

The benefits of the invention may only be realized provided the aluminum and X are present as a single phase before appreciable inter-diffusion of Al and Ti occurs. To achieve this, suitable powder or flake-like particles of Al—X may be prepared by the methods illustrated in FIGS. 3 and 4. In FIG. 3, Aluminum and X in appropriate proportions are melted together, generally under inert atmosphere to produce an Al—X liquid 30 of homogeneous composition in furnace 37 comprising heating elements 32 and furnace wall 34. Homogeneous liquid 30 is then expelled, through nozzle 36 as molten metal stream 38. Water or gas jets 40, originating from nozzles 42 are mounted on circular manifold 44 which surrounds molten metal stream 38. Each of jets 40 is oriented and positioned to direct a jet of water or gas at common location 41 of molten metal stream 38. When manifold 44 is fed by pressurized water or gas from pressure source 46 the water or gas is directed toward location 41 on the molten metal stream. The cooperative effect of all of the impinging fluid flow on molten metal stream being to disperse and break up the metal stream to form molten metal particles 50', which, on solidifying are collected as metal powder particles 50. Even with gas cooling, cooling rates of up to about 100 K/second may be achieved.

Figure 4:
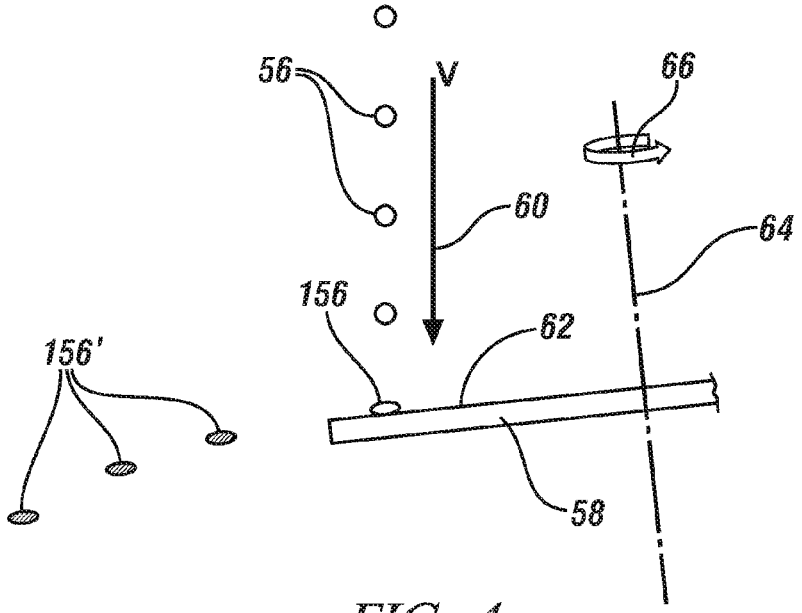
FIG. 4 schematically illustrates a splat cooling apparatus.

A method for producing metal powder or metal flakes under even more aggressive cooling is illustrated in FIG. 4. Again a homogeneous molten alloy of Aluminum and X is prepared. In this case the flow of molten metal emerging from a nozzle (not shown) breaks up to form a stream of molten metal droplets 56. The molten metal droplets 56 are directed against surface 62 of disc 58 spinning about its axis 64 in a direction indicated by arrow 66. Disc 58 is fabricated of a high conductivity material like substantially pure copper. When contacted by droplet 56 the droplet will at least flatten as shown at 156 or may splat and spread into an irregular generally planar shape depending on the impact velocity v. The spread droplet 156, by virtue of its large surface area in contact with heat extracting disc 58, will cool rapidly and at least begin to solidify before being thrown off the surface 62 of spinning disc 58 by centrifugal force as solid or near-solid particles 156'. Cooling rates achievable with splat cooling generally range from about $10^4$ K/second for the configuration shown and may be even greater in devices which trap the droplets between opposing heat extracting surfaces and expel them as flakes.

In an alternative embodiment the alloy may be melt spun, a process in which a thin stream of liquid is brought into contact with the rim of a cooling wheel, normally fabricated of copper. By appropriate adjustment of the flow rate of the liquid stream, a thin ribbon of rapidly-cooled alloy may be formed. In this embodiment at least a second step to reduce the ribbon to a plurality of appropriately-sized particles or flakes suitable for sintering will be required.

Figure 5:
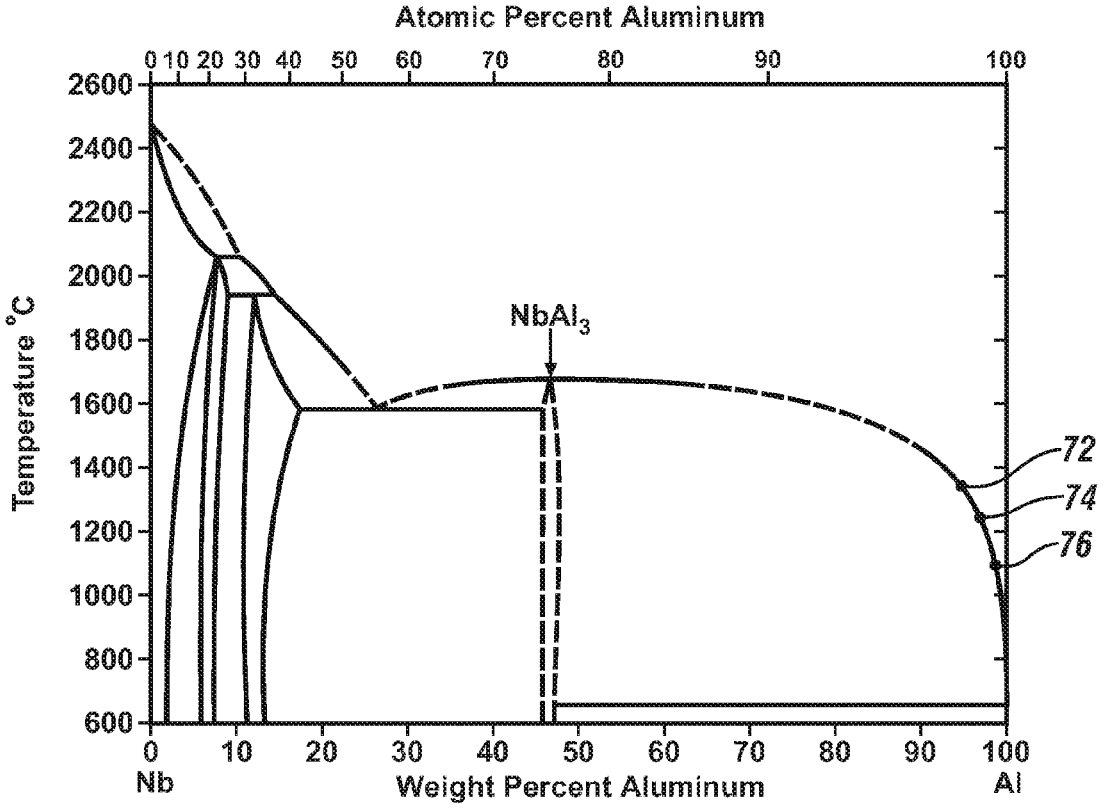
FIG. 5 shows the Aluminum-Niobium binary phase diagram and identifies the liquidus temperatures for Al—Nb alloys containing 1 wt %, 3 wt. % and 5 wt. % Nb.

The rapid cooling obtained with any of these cooling practices will limit the extent to which the molten aluminum may segregate on cooling. Consider FIG. 5, which shows the Aluminum-Niobium phase diagram and is representative of the phase behavior of Al—X alloys generally. Nb is substantially insoluble in solid aluminum and dissolves to an appreciable extent in liquid aluminum only at temperatures significantly elevated above the melting point of aluminum (around 660° C.). For example 1 wt. % Nb Al—Nb alloy 76 will be fully molten at about 1100° C.; 3 wt % NbAl—Nb alloy 74 at about 1250° C. or so; and alloy 72, comprising 5 wt. % Nb at about 1350° C.

Cooling a homogeneous solution of Al—X containing 1-5% by weight of Nb, at conventional cooling rates encountered in castings, will precipitate $NbAl_3$ which will grow and coarsen as the melt cools to about room temperature of 25° C. or so to form a microstructure of coarse $NbAl_3$ particles in a substantially pure Al matrix. This coarse dispersion of $NbAl_3$, will resist re-dissolution in the aluminum so that the benefits of a single homogeneous liquid Al—X composition illustrated in FIG. 2 may not be obtained. This problem may be resolved by rapidly cooling the Al—X melt as described to both inhibit precipitation of $NbAl_3$ and to ensure that any $NbAl_3$ which does form will be in the form of small dispersed particles. Rapid cooling will therefore result in a less-thanequilibrium concentration of $NbAl_3$ particles in a Nb-supersaturated Al matrix, a structure which may be readily reconstituted into a homogeneous liquid very early in a sintering process.

For ease of handling and compacting into a powder compact more regularly-shaped particles such as those prepared by gas atomization are preferred. But irregular particles, even very irregular splat-cooled particles, are functionally acceptable since on melting during sintering, capillary action will convey the liquid throughout the compact and ensure that all Ti particles are wetted.

It will be appreciated that the re-formation of a homogenous liquid of Al and Nb on remelting the rapidly-cooled Al—Nb particles requires that the temperature be sufficient to decompose all of the $NbAl_3$ particles. But, on heating, the substantially pure aluminum matrix will melt first. At a slow heating rate, the supersaturated aluminum may spend appreciable time at a temperature suitable for precipitating excess Nb, forming yet additional $NbAl_3$ and molten aluminum. If significant reaction occurs between the molten aluminum and titanium particles before a temperature suitable for dissolution of $NbAl_3$ is attained, not all of the benefits of the invention may be realized. It is therefore preferred that the powder compact be rapidly heated, preferably at a rate comparable to the rate at which it was cooled, so that rapid dissolution of $NbAl_3$ results to render a homogeneous Al—Nb liquid early in the sintering process. Spark plasma sintering or SPS (also known as field assisted sintering technique or pulsed electric current sintering) is a suitable sintering process. The main characteristic of SPS is that the pulsed DC current is passed through the powder compact so that heat is generated internally to provide a very high heating rate of up to 10 K/sec. Such a heating rate is sufficient to rapidly re-dissolve the $NbAl_3$ particles and enable practice of the invention.

In a typical SPS process, a powder compact is produced by pressing together a suitable mixture of the desired elemental or alloy powders, ranging in size from 3 to 50 micrometers, in a shaped die. A separate compacting die may be employed or the SPS die may be used. For the SPS process a graphite die coated with a suitable high-temperature, anti-stick material such as boron nitride (BN) is used. Once placed in the SPS die the powder compact is heated by passing a pulsed electric current in the range of from about 1000 Amp to about 5000 Amp while under an applied force which may range from about 5 kN to 200 kN. The electric current causes a rapid heating of the powder compact promoting heating rates up to 600° C./minute. A preset temperature which may range from 700° C. to 1600° C. is maintained for a suitable period to promote rapid sintering, densification and homogenization of the compact. Suitable sintering times may range from between a few seconds to a few hours and may be established based on trials or modeling for specific materials and process parameters.

Other sintering processes employing rapid heating such as by means of a laser beam, an infrared beam or induction heating, if capable of achieving rapid heating rates, may also be suitable. Suitably such rapid heating rates may range from about 5K per second to about 20K per second.

The above descriptions of embodiments of the invention are intended to illustrate the invention and not intended to limit the claimed scope of the invention.

The invention claimed is:

1. A method of forming a substantially pore-free titanium aluminide article comprising gamma titanium aluminide (γ-TiAl), the formed gamma titanium aluminide containing at least one alloying metallic element, the method employing substantially pure titanium powder, the method further comprising:

dissolving one or more alloying elements in aluminum by heating the aluminum to a temperature sufficient to melt the aluminum and completely dissolve the alloying element;

rapidly freezing the molten alloyed aluminum at a rate sufficient to substantially suppress separation of the dissolved element from the aluminum and render an aluminum-based supersaturated solid; and co-sintering particles of the aluminum-based supersaturated solid with substantially pure titanium powder for a time sufficient to form the alloyed titanium aluminide article in which the major phase is gamma titanium aluminide with the alloying element in solution in the phase, or with the alloying element in a dispersed secondary phase.

2. The method of forming a substantially pore-free titanium aluminide article with at least one alloying element as recited in claim 1 in which the alloying element comprises one or more of Nb, Cr, Mn, Mo, Si, Cu, Fe, Sn and V.

3. The method of forming a substantially pore-free titanium aluminide article with at least one alloying element recited in claim 1 in which the total alloying element(s) are present in an amount ranging from 0.1 to 10 atomic % of the gamma titanium aluminide.

4. The method of forming a substantially pore-free titanium aluminide article with at least one alloying element as recited in claim 1 in which titanium and aluminum are present in substantially equal atomic proportions.

5. The method of forming a substantially pore-free titanium aluminide article with at least one alloying element as recited in claim 1 in which the molten alloyed aluminum is cooled by gas atomization utilizing water to produce particles of an aluminum-based supersaturated solid.

6. The method of forming a substantially pore-free titanium aluminide article with at least one alloying element as recited in claim 1 in which the molten alloyed aluminum is splat cooled to produce particles of an aluminum-based supersaturated solid.

7. The method of forming a substantially pore-free titanium aluminide article with at least one alloying element as recited in claim 1 in which co-sintering is performed utilizing using a rapid sintering process.

8. The method of forming a substantially pore-free titanium aluminide article with at least one alloying element as recited in claim 1 in which co-sintering is performed utilizing spark plasma sintering.

9. A substantially pore-free titanium aluminide article comprising a major phase of gamma titanium aluminide with the alloying element in solution in the gamma titanium aluminide phase or with the alloying element in a secondary phase and employing substantially pure titanium powder and prepared by the method of claim 1.

10. The substantially pore-free titanium aluminide article comprising gamma titanium aluminide recited in claim 9 in which the alloying element comprises one or more of Nb, Cr, Mn, Mo, Si, Cu, Fe, Sn and V.

11. The substantially pore-free titanium aluminide article comprising gamma titanium aluminide recited in claim 9 in which the total alloying element(s) are present in an amount ranging from 0.1 to 10 atomic % of the gamma titanium aluminide.

12. The substantially pore-free titanium aluminide article comprising gamma titanium aluminide recited in claim 9 in which titanium and aluminum are present in substantially equal atomic proportions.

13. The substantially pore-free titanium aluminide article comprising gamma titanium aluminide recited in claim 9 fabricated utilizing rapid sintering.

14. The substantially pore-free titanium aluminide article comprising gamma titanium aluminide recited in claim 9 fabricated utilizing spark plasma sintering.

15. The substantially pore-free titanium aluminide article comprising gamma titanium aluminide recited in claim 9 in which the article is a valve for an automobile engine.

16. The substantially pore-free titanium aluminide article comprising gamma titanium aluminide recited in claim 9 in which the article is a connecting rod for an automobile engine.

* * * * *